US007693294B2

(12) United States Patent
Schneider et al.

(10) Patent No.: US 7,693,294 B2
(45) Date of Patent: Apr. 6, 2010

(54) METHOD AND SYSTEM FOR REDUCING AUDIBLE SIDE EFFECTS OF DYNAMIC CURRENT CONSUMPTION

(75) Inventors: Todd Schneider, Waterloo (CA); Andreas Drollinger, La Chaux-de-Fonds (CH); Marc Matthey, Neuchatel (CH); Jakob Nielsen, Waterloo (CA)

(73) Assignee: AMI Semiconductor, Inc., Pocatello, ID (US)

( * ) Notice: Subject to any disclaimer, the term of this patent is extended or adjusted under 35 U.S.C. 154(b) by 1379 days.

(21) Appl. No.: 11/091,743

(22) Filed: Mar. 28, 2005

(65) Prior Publication Data

US 2005/0234711 A1 Oct. 20, 2005

(30) Foreign Application Priority Data

Mar. 30, 2004 (CA) ..... 2462463

(51) Int. Cl.
*H04R 25/00* (2006.01)

(52) U.S. Cl. ..... 381/314; 381/312; 381/60

(58) Field of Classification Search ..... 381/312–331; 700/94; 712/226; 713/300–340, 600–601, 713/226, 501
See application file for complete search history.

(56) References Cited

U.S. PATENT DOCUMENTS

| | | | | |
|---|---|---|---|---|
| 7,000,138 | B1 * | 2/2006 | Pillay et al. | 713/600 |
| 2001/0002930 | A1 * | 6/2001 | Kates | 381/317 |
| 2002/0136417 | A1 | 9/2002 | Ku et al. | 381/94.1 |
| 2006/0063495 | A1 * | 3/2006 | Hamilton | 455/90.3 |
| 2008/0141062 | A1 * | 6/2008 | Yamaoka | 713/501 |

FOREIGN PATENT DOCUMENTS

| | | |
|---|---|---|
| CA | 1284529 | 5/1991 |
| EP | 0 418 036 A2 | 9/1990 |

* cited by examiner

*Primary Examiner*—Quoc D Tran
*Assistant Examiner*—Ryan C Robinson
(74) *Attorney, Agent, or Firm*—Perman & Green LLP

(57) ABSTRACT

A method and system for reducing audible side effects of dynamic current consumption is provided. The system includes an audio subsystem, and a plurality of digital subsystems. The audio subsystem and the digital subsystem are powered by a common power supply. T he digital subsystem processes data packets including audio data packets. The processing events implemented in one or more than one digital subsystem are reorganized to change the profile for executing the events inside the subsystem(s). The dynamic current spectral properties in one or more digital subsystems are changed.

18 Claims, 15 Drawing Sheets

METHOD AND SYSTEM FOR REDUCING AUDIBLE SIDE EFFECTS OF DYNAMIC CURRENT CONSUMPTION

CROSS-REFERENCE TO RELATED APPLICATIONS

This application claims priority from Canadian Patent Application No. 2,462,463, filed on Mar. 30, 2004.

FIELD OF INVENTION

The present invention relates generally to signal processing technology for listening devices, and more particularly to a method and system for reducing audible side effects of dynamic current consumption.

BACKGROUND OF THE INVENTION

Head mounted listening devices, such as hearing aids and headsets or similar devices, have been developed in recent years. In hearing aids for instance in an "In-The-Ear"(ITE) or in an "Behind-The-Ear" (BTE) application, an input audio signal is processed through signal processing, and is transmitted to the user of the hearing aid.

In listening devices, the signal processing should result in improvements in speech intelligibility and sound quality. Typically, tradeoffs between size, power consumption and noise are made by the listening device designer as part of their design process. Designers want more processing capability (which is proportional to power consumption) and the smallest size possible. Once a designer has determined an acceptable size and power consumption, the noise level (either tonal or stochastic) must be addressed. If designers push the size and/or power consumption parameters too far, undesired audible side effects (artifacts) on the output of the listening devices, in the form of tonal or stochastic noise, may result.

Currently available listening devices usually contain an audio subsystem (such as amplification units, aliasing filtering units, analog-to-digital (A/D) conversion units, digital-to-analog (D/A) conversion units, a receiver, a loudspeaker), and a plurality of subsystems, each of which performs signal processing.

For instance, consider a listening device system that contains one or more victim subsystems (Vx1, Vx2, . . . ) and one or more attacker subsystem (Ay1, Ay2, . . . ). The listening device system may contain one or more others subsystem (Oz). All the subsystems are connected to a common power supply (P). The common power supply (P) provides a voltage (U) and a current (I) to the listening device system. The victim subsystems (Yx1, Vx2, . . . )are characterized as sensitive to a variation in the voltage (U) of the common power supply (P). The attacker subsystems (Ay1, Ay2, . . . ) are characterized as consuming a dynamic current (dIy) through the common power supply (P). The dynamic current (dIy) is periodic with a period (Ty). The other subsystems (Oz) are characterized as non-sensitive to a variation of the power supply voltage and are not consuming a periodic dynamic current through the common power supply (P). A subsystem could be a victim and an attacker. Each dynamic current (dIy) produces a variation of the voltage (U) of the common power supply (P) equal to the internal resistor of the power supply (Rs) divided by the dynamic current (dIy). The sum of the periodic dynamic current (dIy) produces a voltage variation (dU) of the power supply (P). The spectrum of the voltage variation (dU) is the resulting power supply noise (SN). The audible power supply noise (AN) is a part of the power supply noise (SN) characterized by the fact that it is in the audio-band of interest (typically 20 Hz to 20 kHz but not limited hereto). Noise is classified as any unwanted or undesired audio signal.

For example, the victim subsystem (Vx1) is an audio subsystem, and the audio subsystem (Vx1) and two aggressor digital subsystems (Ay1, Ay2) are powered by the common power supply (P). The subsystem (Ay1) may process data 2000 times per second while the subsystem (Ay2) may process data packets 32000 times a second. Assume that processing a data packet is associated with drawing current from the common power supply (P), the subsystem (Ay1) draws current 2000 times per second while the subsystem (Ay2) draws current 32000 times per second.

As such, this current which each subsystem draws is dynamic in nature, and may couple into the audio subsystem through the common power supply (P). In this case, the dynamic current draw caused by the subsystem (Ay1) could potentially result in a voltage variation on the common power supply (P) as a result of the dynamic current drawn through the shared output resistance of the common power supply (P). Since the audio subsystem (Vx1) is also powered by the common power supply (P), this voltage variation could potentially propagate through the audio subsystem (Vx1) and therefore also into the audio path causing audible clicks, pops, tones or other undesired audible side effects.

The audible side effects related to dynamic current are often solved by using external, large-size passive-component solutions in the form of capacitors, resistors, and/or inductors, which are applied to power supply voltages going in or out of the subsystems. These passive-component solutions constitute filters that reduce the voltage variations. Depending on the frequency and amplitude of the voltage variations, the filters can require more or larger passive components. However, adding more or larger passive components is not beneficial in a space constrained application like a listening device.

Another solution for resolving the problem is reducing the sensitivity of the victim subsystems to the dynamic current. Here, several techniques are used including (but not limited to): internal power supply filtering in the subsystem, and use of a digital design approach rather than an analog design approach. An internal power supply filter reduces the audible side effects of dynamic current in the same manner as external filters.

It is therefore desirable to provide a method and system, which allows designers to realize small size and computationally capable listening device designs and can reduce audible side effects of dynamic current consumption without the need for large, external solutions as described above.

SUMMARY OF THE INVENTION

It is an object of the invention to provide a novel method and system that obviates or mitigates at least one of the disadvantages of existing systems.

The invention provides a novel method and system to reduce the audible side effects that are a result of power supply voltage variation resulting from dynamic current consumption.

In accordance with an aspect of the present invention, there is provided a method of reducing the audible side effects of dynamic current consumption in a listening device having a plurality of subsystems. The method includes the steps of: executing a plurality of processing events in a subsystem, the processing events being periodic; monitoring dynamic current caused by one or more than one of the processing events, and reorganizing one or more than one of the processing events to change a dynamic current spectrum property associated with the dynamic current.

In accordance with a further aspect of the present invention, there is provided an audio system which includes: an audio subsystem; a plurality of processing subsystems, each for executing a plurality of processing events, the audio subsystem and the processing subsystems being connected to a common power supply, and a module for reorganizing one or more than one of the processing events to change a dynamic current spectrum property associated with the dynamic current.

In accordance with a further aspect of the present invention, there is provided a system for reducing side effects of dynamic current consumption in a listening device having a plurality of processing subsystems. The system includes: a module for monitoring a dynamic current caused by one or more than one processing event implemented in one or more than one of the subsystems, and a module for reorganizing one or more than one of the processing events to change a dynamic current spectrum property associated with the dynamic current.

In accordance with a further aspect of the present invention, there is provided a computer program product, which includes a memory having computer-readable code embodied therein of reducing the audible side effects of dynamic current consumption in a listening device having a plurality of subsystems, including: code for defining a plurality of processing events executed in one or more than one of the subsystems; code for reorganizing one or more than one of the processing events with respect to execution timing, duration or a combination thereof to change a dynamic current spectrum property associated with the dynamic current.

Other aspects and features of the present invention will be readily apparent to those skilled in the art from a review of the following detailed description of preferred embodiments in conjunction with the accompanying drawings.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENTS

The present invention is suitably used for audio systems such as head mounted listening devices, in particular hearing aids, headsets, and other assistive listening devices (hereinafter referred to as "hearing aids" but not limited to this type of device). The methods of the present invention apply in general to other audio processing systems that have at least one audio subsystem (victim) and at least one digital processing system (aggressor), both supplied from a common power supply.

An embodiment of the present invention provides a method of reducing the undesired audible side effects caused by dynamic current consumption in a hearing aid, especially, in at least one subsystem that is part of an audio processing system. The audible effects may be, but not necessarily limited to, tones, clicks, pops or other undesired sound effects entering the ear of the hearing aid user.

Figure 1:
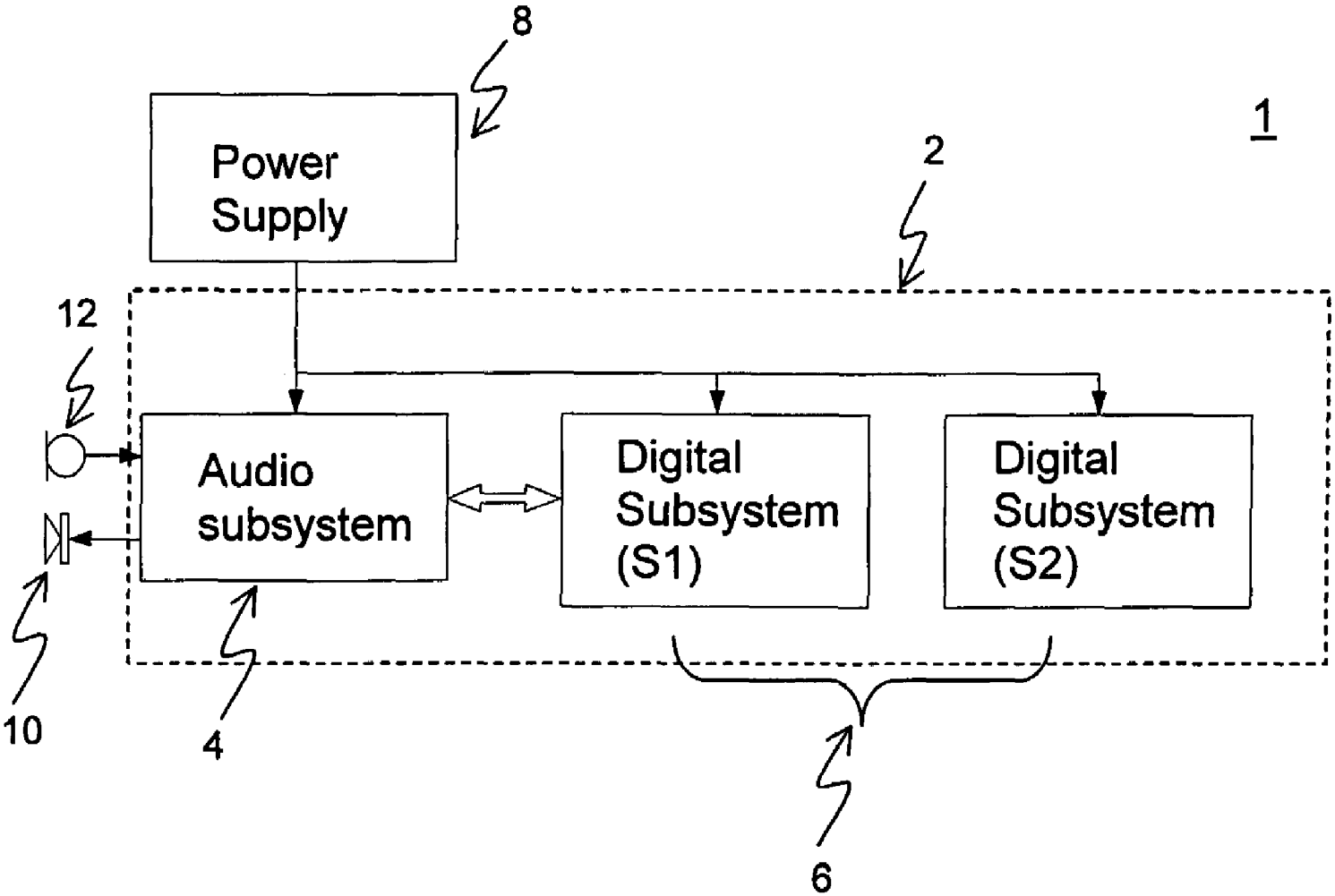
FIG. 1 is a schematic diagram showing an example of a hearing aid to which side effects reduction in accordance with an embodiment of the present invention is suitably applied.

FIG. 1 shows a hearing aid 1 to which side effects reduction in accordance with an embodiment of the present invention is suitably applied. The hearing aid 1 contains an audio processing system 2 with at least one electronic circuit that incorporates an audio subsystem-4 (victim subsystem), and one or more digital subsystems 6 (one or more attacker subsystems). Each of the digital subsystems 6 is denoted by Sx, where "x" is the number of a particular subsystem. The audio subsystem 4 and the digital subsystems 6 are powered by a common power supply 8.

The audio processing system 2 may include the other subsystems (Oz) which are characterized as non-sensitive to a variation of the power supply voltage and are not consuming a periodic dynamic current through the common power supply 8.

The audio subsystem 4 may include an analog-to-digital (A/D) converter as a minimum and can optionally include amplification units, aliasing filtering units, digital-to-analog (D/A) conversion units, wireless receiver/transmitter or combinations thereof. Some of the subsystems listed above are by nature sensitive to variations in the power supply voltage. The A/D converter converts an analog audio signal to digital samples at one or more sampling frequencies.

The hearing aid 1 may further contain audio transducers, such as microphone and receiver, trimmers, and other input/output (I/O) related components specific for the actual hearing aid. In FIG. 1, a loud speaker 10 and a microphone 12 are shown. An audio signal from the surrounding environment enters the microphone 12 where it is converted to an electrical signal. Subsequently this electrical signal is directed to the audio subsystem 4. The audio subsystem 4 performs signal conditioning and analog to digital (A/D) conversion. The digitized audio signal is subsequently directed to either of the signal processing subsystems S1 and S2, where it is processed according to a processing scheme, and subsequently directed back to the audio subsystem 4. In the audio subsystem 4, the signal processed in the audio processing system 2 is converted to a representation suitable for producing the desired audio signal in the hearing aid loud speaker 10.

Each of the subsystems S1 and S2 may include one of the following functional entities: one or more digital signal processors (DSPs) that process packets of data (e.g., audio, control signals, other type of signal); one or more dedicated digital co-processors that process packets of data (e.g., audio, control signals, other type of signal); one or more memory blocks (e.g., random access memory (RAM), read only memory (ROM), one or more fixed-functions (e.g., fast Fourier transform (FFT), discrete cosine transform (DCT), filters). The co-processor may be, for instance, a filtering subsystem, a compression subsystem, a frequency domain processing subsystem, or a time domain processing subsystem but are not necessarily limited to any of these. Each data packet processed in the subsystems S1 and S2 may be a single audio sample, a block of audio samples, or a single sample or block of other type of data in case of processing a block of samples the frequency of each block will be a submultiple of the frequency of the single sample frequency. The time period for processing a block is also referred to as a processing window.

Figure 2:
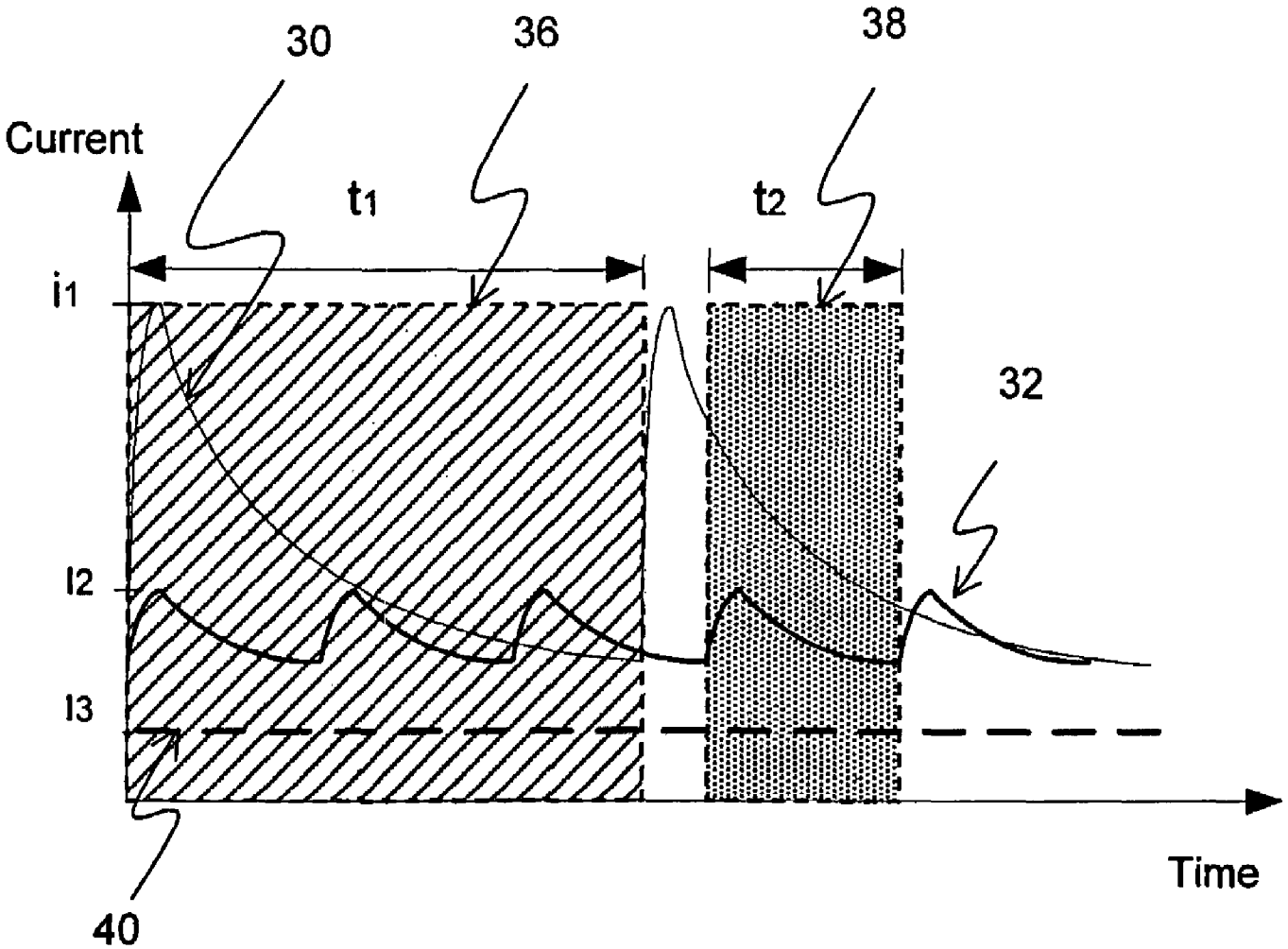
FIG. 2 is a diagram showing one example of dynamic current when the side effects reduction is not applied to the system of FIG. 1.

FIG. 2 is a diagram showing one example of dynamic current when the side effects reduction is not applied to the system of FIG. 1.

Processing of data packets is associated with drawing current from the power supply 8. The subsystem S1 draws current from the power supply 8 at a frequency of $f_1$, resulting a duration of $t_1=1/f_1$, whereas the subsystem S2 draws current from the power supply 8 at a frequency of $f_2$, resulting a duration of $t_2=1/f_2$.

In FIG. 2, "36" and "38" represent processing windows (i.e., the time periods $t_1$ and $t_2$ at which processing events are performed inside the subsystems S1 and S2) for the subsystems S1 and S2, respectively. In a real-time system, the processing window determines the maximum time period in which a sample, or a block of samples, has to be processed. As such, a processing window is periodic in nature.

In the description below, the amount of processing performed inside a processing window for a given subsystem (Sx) is referred to as the load (Lx) for that subsystem (Sx). In the hearing aid 1 of FIG. 1, "L1" is the load for subsystem S1, and "L2" is the load for subsystem S2. The load Lx for a given subsystem Sx inside a processing window includes one or more processing events.

The load is normally associated with the amount of data being subject to computations and the number of memory accesses performed. However, this correlation is not a requirement. In general, the more processing of data completed and the more memory accesses the higher the load and therefore the higher the amplitude of the dynamic current consumption for a particular subsystem.

The properties of the dynamic current can be viewed in at least two ways. The amplitude variation over time and the amplitude variation over frequency. The amplitude variation over time for the dynamic current is referred to as dynamic current waveform. The amplitude variation over frequency is referred to as dynamic current spectrum. The dynamic current spectrum may be obtained from the dynamic current waveform by means of a fast-Fourier transformation or similar transformation.

In FIG. 2, "30" and "32" represent dynamic current waveforms for dynamic currents drawn from the power supply 8, which are caused by the subsystems S1 and S2 of FIG. 1, respectively. Each of "30" and "32" shows the "peaky" nature of the dynamic current. For comparison, in FIG. 2, static current 40 is shown, which would not be "peaky" in nature but constant in time.

Each of the dynamic current waveforms 30 and 32 shows the amplitude of the dynamic current as a function of time. In FIG. 2, the dynamic current waveform 30 is for the processing window 36 of one subsystem S1, and the dynamic current waveform 32 is for the processing window 38 of the subsystem S2. It is readily apparent to a person skilled in the art that the fundamental frequency of the dynamic current waveform 32 is higher than the fundamental frequency of the dynamic current waveform 30. As such, the spectrum for the dynamic current waveform 32 has a higher fundamental frequency than the spectrum for the dynamic current waveform 30.

The characteristic of each spectrum associated with the dynamic current waveform of a subsystem is referred to as Dynamic Current Spectrum Property (DCSP). It is apparent to a person skilled in the art that DCSP includes amplitude, frequency, and a combination thereof.

The level of undesired noise is related to the spectral properties of the dynamic current consumed in the audio processing system 2 that contains the subsystems, where noise encapsulates all undesired audible side effects. The embodiment of the present invention provides a method of reducing undesired audible side effects by changing DCSP(s) of the dynamic current.

The DCSP of the dynamic current may be changed at least two different ways: by changing frequency, by changing amplitude of the dynamic current waveform or a combination thereof, in accordance with the definition of DCSP.

There are at least two types of dynamic current of interest to the design of a listening device, In-Audio-Band (IAB) dynamic current and Out-of-Audio-Band (OAB) dynamic current. The IAB dynamic current is defined as dynamic current with a fundamental frequency that lies within the audio band of interest for the input and/or output signals. In this case, undesired audio side effects will occur inside the audio band of interest. The OAB dynamic current is defined as dynamic current with a fundamental frequency that lies outside the audio band of interest for the input and/or output signals. In this case, undesired audio artifacts will occur outside the audio band of interest.

For the amplitude of the spectrum, the undesired audible side effects are proportional to the amplitude of the dynamic currentaudible side effect.

Figure 3:
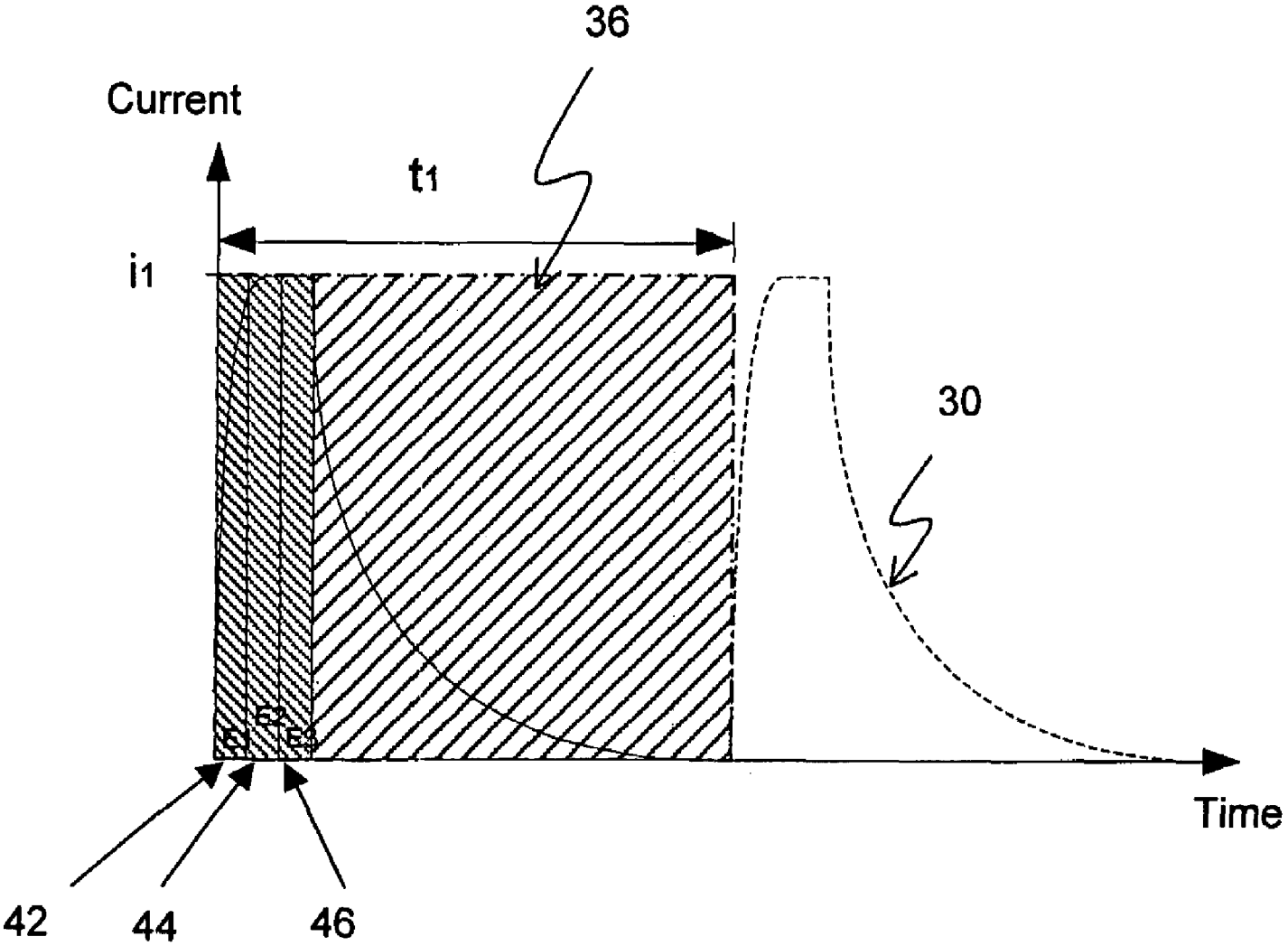
FIG. 3 is a diagram showing one example of processing events when the side effects reduction is not applied to the system of FIG. 1.

FIG. 3 is a diagram showing one example of processing events when the side effects reduction is not applied to the system of FIG. 1. In FIG. 3, "42", "44" and "46" represent processing events within the processing window 36 for the subsystem S1 of FIG. 1.

For example, the load L1 inside the processing window 36 for the subsystem S1 includes three processing events 42, 44, and 46 executed immediately after each other. Each of the processing events 42, 44, 46 represents some necessary amount of processing i.e., instruction execution and memory accesses).

Since the processing events 42, 44, and 46 are executed immediately after each other, the dynamic current has a fundamental frequency equal to the period of the processing window 36. If this fundamental frequency results in an IAB dynamic current when the processing events 42, 44 and 46 are executed, then undesired audible audible side effects may be induced into the audio subsystem (4 of FIG. 1).

In a digital system, all events are executed in accordance with a clock. The clock can be considered as the "engine," i.e., it drives the execution of processing events. If the clock is fast, many events can be executed quickly. If the clock is slow it takes longer to execute the same amount of processing events. In FIG. 3, the processing window 36 has a time duration of 30 clock cycles; and each of three processing events 42, 44, and 46 takes 5 clock cycles to execute. The processing event 42 is executed during cycles 1-5, the processing event 44 is executed during cycles 6-10, and the processing event 46 is executed during cycles 11-15.

In FIG. 3, three processing events 42, 44 and 46 are shown. However, the load L1 includes one, two or more than three processing events within a processing window.

Changing DCSP(s) influences the execution of processing events (e.g., 42-46 of FIG. 3) within a processing window (e.g., 36 of FIG. 3) for a given digital subsystem (e.g., S1, S2 or S1 and S2 of FIG. 1). For example, an IAB dynamic current is transformed to an OAB dynamic current (change of frequency); the amplitude of the dynamic current is transformed from audible to inaudible (change of amplitude); or a combination thereof.

Changing DCSP(s) is implemented by the method of (1) an Interleaved Execution of Processing Events; (2) a Slowed Execution of Processing Events; (3) an Execution of Dummy Processing Events; (4) a Random Delayed Execution of Processing Events; or (5) combinations thereof. The DCSP change methods (1)-(5) affect one or more than one of the DCSPs.

The DCSP method (1) may be chosen for an application where there are no strict requirements as to when processing events are executed within a processing window, i.e., changing the instants in time at which processing events occur within a processing window does not adversely affect the application. The DCSP method (2) may be chosen for an application where the duration of the execution event is not critical, i.e., extended duration of a processing event within a processing window does not adversely affect the application. The DCSP method (3) may be chosen for an application where timing and duration of processing events within a processing window are critical, i.e., where the instants in time or duration of processing events within a processing window cannot be changed. The DCSP method (4) may be chosen for an application where the timing of processing events across processing windows is not critical, i.e., where one processing event may be executed at an instant in time within one processing window and at a second, different instant in time in a second processing window. Two or more than two DCSP methods may be chosen as the DCSP method (5).

Referring to FIG. 1, the audio processing system 2 may include module for implementing one or more than one of the DCSP change methods (1)-(5). One or more digital subsystems may contain the module for implementing the DCSP change methods (1)-(5). The module may selectively implement the DCSP change methods (1)-(5).

Changing DCSP through the Interleaved Execution of Processing Events is now described in detail. In the process of the Interleaved Execution of Processing Events, the DCSP of the dynamic current waveform for a particular subsystem is modified by changing the interleaving properties of one or more processing events inside a processing window for that subsystem. The interleaving properties include the time intervals between the processing events within the processing window.

For example, the DCSP change method adjusts the timing of each processing event (e.g., 42, 44, 46) in a processing window (e.g., 36). The processing events are spread out with a certain time interval inside the processing window. As a result the dynamic current is changed from IAB to OAB.

Figure 4:
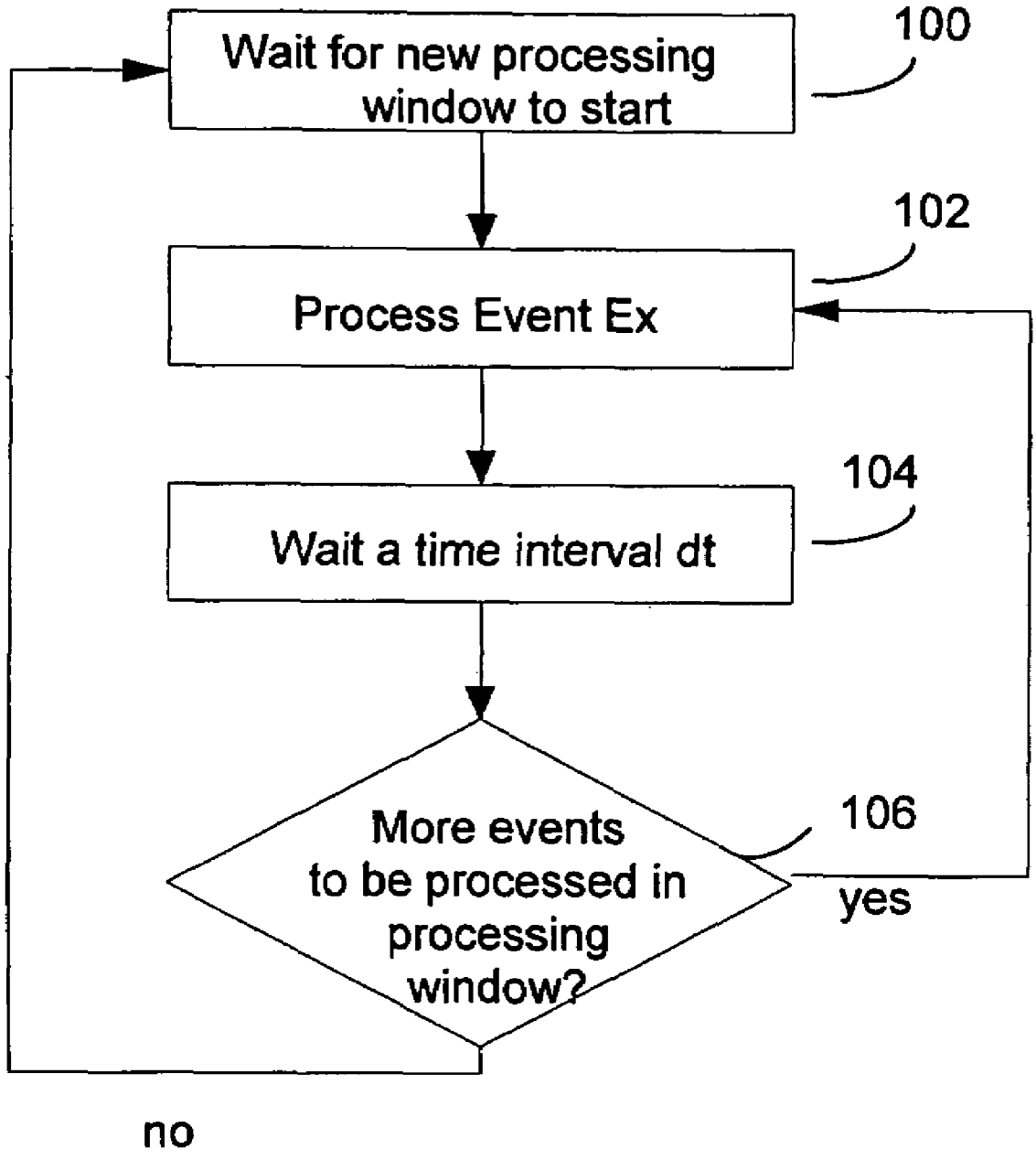
FIG. 4 is a flow chart showing one example of operation for an Interleaved Execution of Processing Events.

FIG. 4 is a flow chart showing one example of operation for the Interleaved Execution of Processing Events.

The digital subsystem Sx (e.g., S1, S2 or S1 and S2 of FIG. 1) waits for start of a new processing window (step 100). In the new processing window, one or more than one processing event Ex is processed (step 102) in the subsystem Sx. The digital subsystem Sx waits a time interval dt (step 104). It is determined whether there is any event(s) to be processed in the processing window (step 106). If yes, the digital subsystem Sx retunes to step 102. If no, the digital subsystem Sx returns to step 100.

Figure 5:
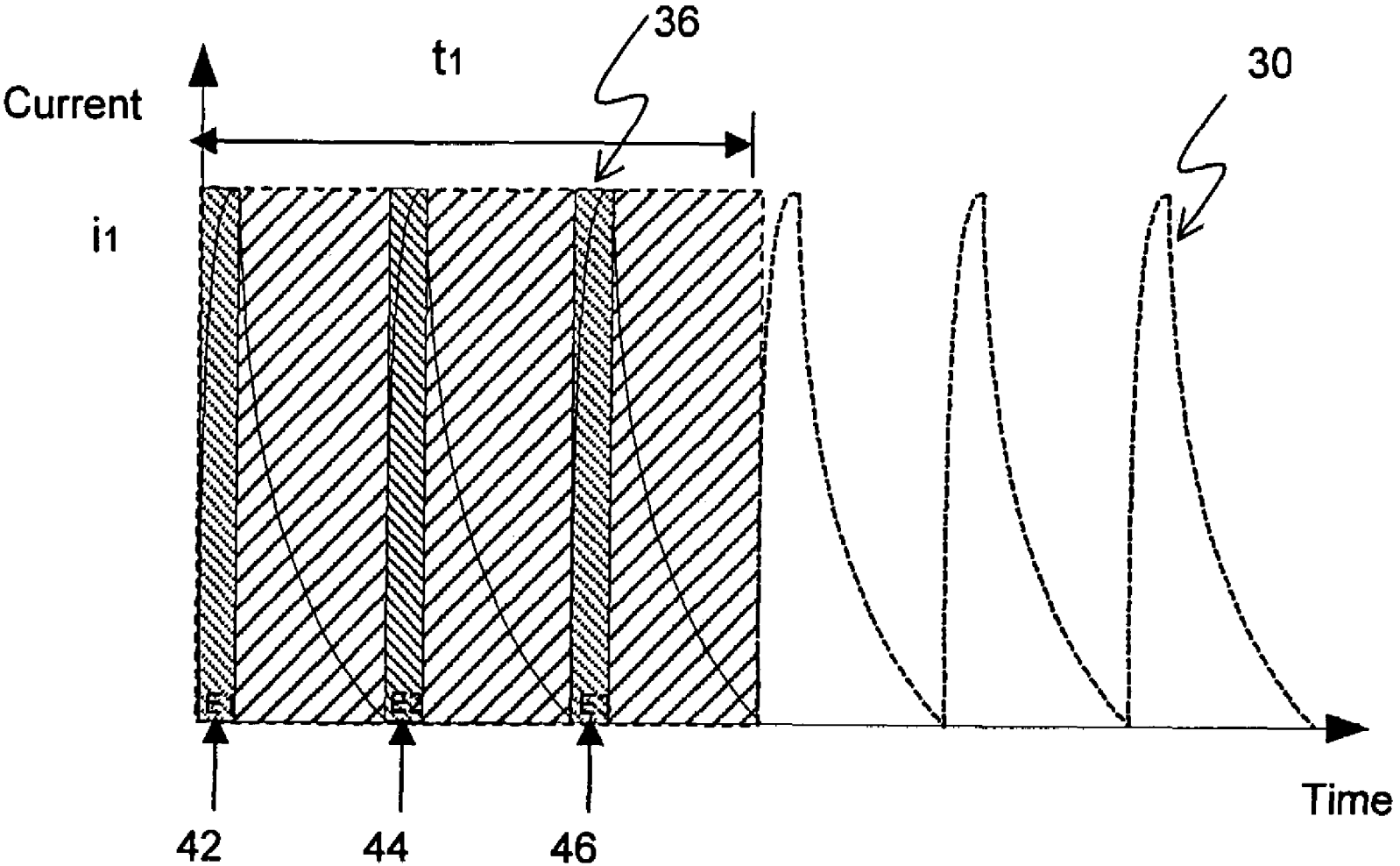
FIG. 5 is a diagram showing one example of the Interleaved Execution of Processing Events.

FIG. 5 is a diagram showing one example of the Interleaved Execution of Processing Events.

For example, by applying the Interleaved Execution of Processing Events to the hearing aid 1 with the profiles of FIG. 2, the processing events 42, 44 and 46 in the processing window 36 for the subsystem S1 are executed as illustrated in FIG. 5. In FIG. 5, the processing event 42 is executed during cycles 1-5, the processing event 44 is executed during cycles 11-15, and the processing event 46 is executed during cycles 21-25.

Referring to FIGS. 4 and 5, adding the time intervals between the processing events 42 and 44 and between the processing events 44 and 46 results in the fundamental frequency of the dynamic current waveform to be changed after interleaving is performed. In this example, it is increased by a factor of three, which may be sufficient to bring the dynamic current waveform from IAB to OAB. For example, if the fundamental frequency is 4 kHz before interleaving it will now be 12 kHz after applying interleaving, which is deemed to be OAB in the intended application.

The fundamental frequency for the dynamic current waveform 30 for the subsystem S1 is increased by spreading out the processing events 42, 44 and 46. It causes the frequency of the dynamic current to be changed since there are now three peaks in the dynamic current waveform instead of one as in the original case (the frequency triples). When each of the processing events 42, 44 and 46 is executed at a desired timing, the fundamental frequency of the dynamic current is transformed into a higher frequency. With this method, an IAB dynamic current is transformed into an OAB dynamic current. If the fundamental frequency of the noise is equal to 4 kHz, which is IAB in the intended application, the modified fundamental frequency of the noise is moved to 12 kHz, which is OAB in the intended application.

Changing DCSP through a Slowed Execution of Processing Events is now described in detail. In the process of the Slowed Execution of Processing Events, the DCSP of the dynamic current waveform for a particular subsystem is changed by lengthening the duration of one or more processing events inside a processing window for that subsystem. For example, the duration is increased so as to perform the desired amount of processing for a given processing event over a longer period of time. As such, the amplitude of the dynamic current waveform is reduced.

Figure 6:
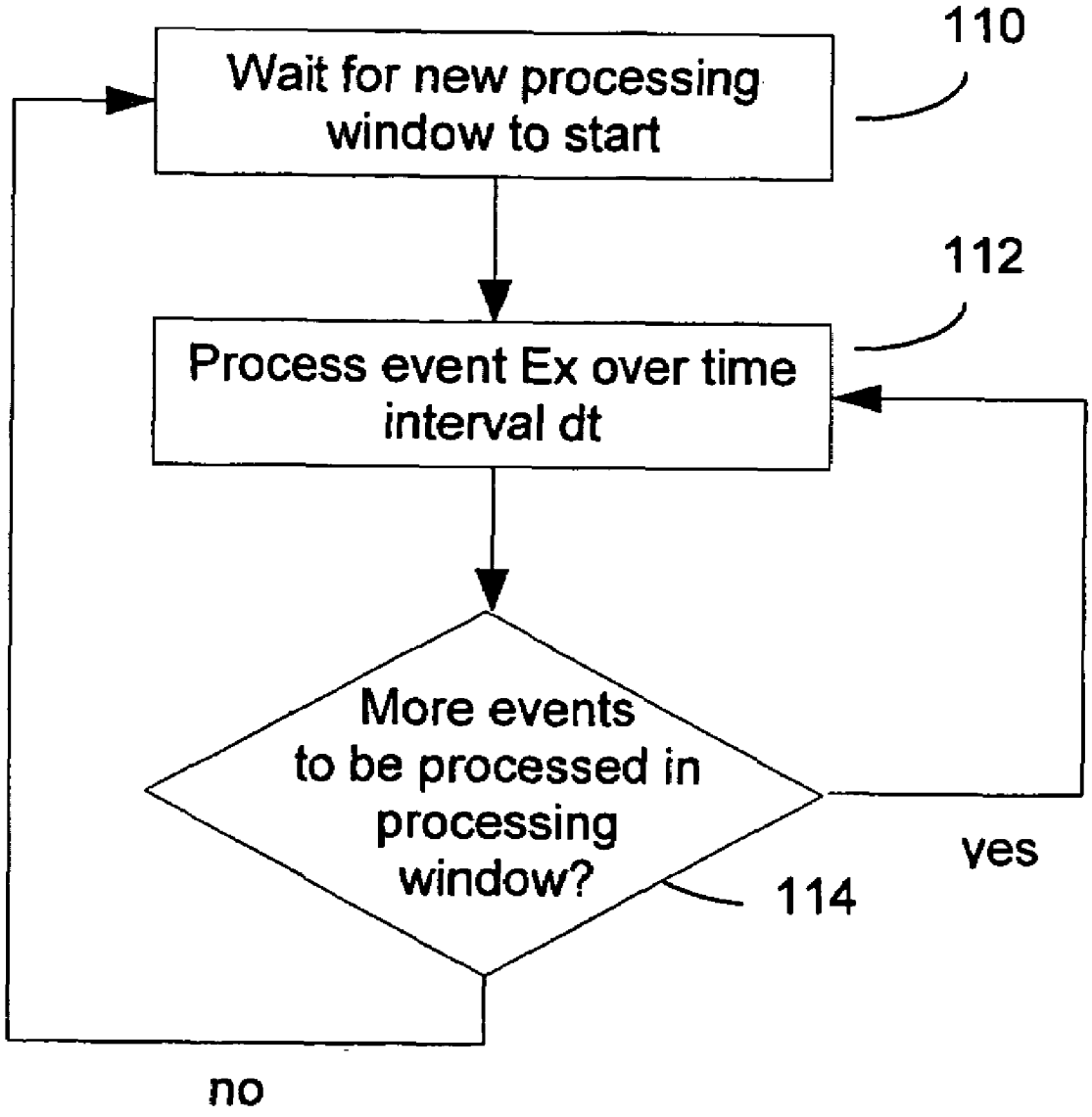
FIG. 6 is a flow chart showing one example of operation for a Slowed. Execution of Processing Events.

FIG. 6 is a flow chart showing one example of operation for the Slowed Execution of Processing Events.

The digital subsystem Sx (e.g., S1, S2 or S1 and S2 of FIG. 1) waits for start of a new processing window (step 110). In the new processing window, one or more than one processing event Ex is executed over a time interval dt (step 112) in the digital subsystem Sx. It is determined whether there is any event(s) to be processed in the processing window (step 114). If yes, the digital subsystem Sx retunes to step 112. If no, the digital subsystem Sx returns to step 110.

Figure 7:
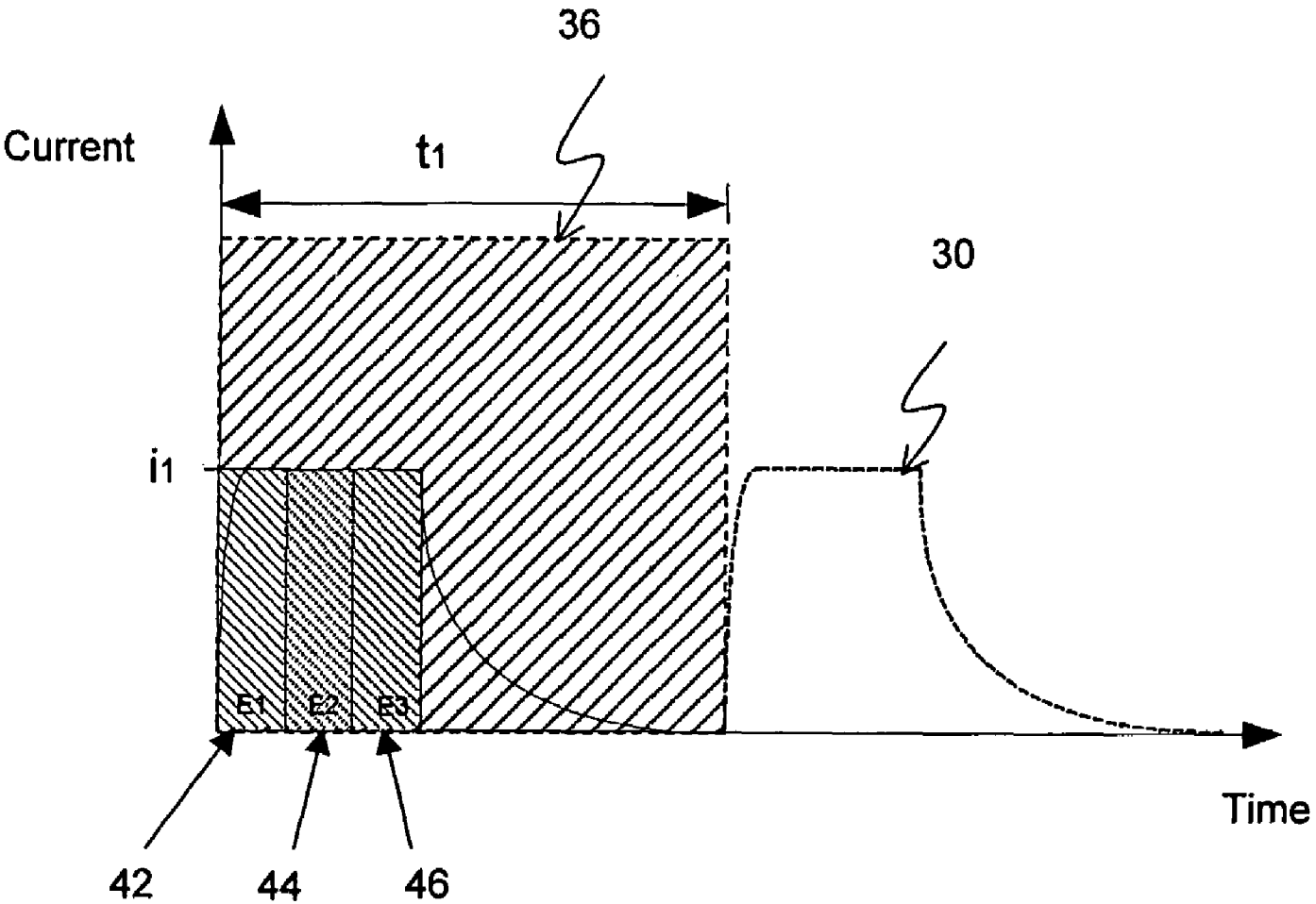
FIG. 7 is a diagram showing one example of the Slowed Execution of Processing Events.

FIG. 7 is a diagram showing one example of the Slowed Execution of Processing Events.

For example, by applying the Slowed Execution of Processing Events to the hearing aid 1 with profiles of FIG. 2, the processing events 42, 44 and 46 in the processing window 36 for the subsystem S1 are executed as illustrated in FIG. 7. The processing event 42 is executed during cycles 1-5, the processing event 44 is executed during cycles 6-10, and the processing event 46 is executed during cycles 11-15. The original durations B1, B2 and B3 for the processing events 42, 44 and 46 are longer to (B1+Δ1), (B2+Δ2) and (B3+Δ3), respectively. As shown in FIG. 7, the amplitude for the dynamic current waveform 30 for the subsystem S1 gets reduced distributing each processing event 42, 44 and 46 inside the processing window 36 over a larger amount of time.

When implementing the process of the Slowed Execution of Processing events, the frequency of a clock is changed. For example, the frequency of a clock is half as the original frequency. As shown in FIG. 7, the processing events 42, 44 and 46 take 15 cycles within the processing window. Thus, the amount of operations still takes 15 cycles. However, the 15 cycles are executed over a time interval that is twice as the original. This changes the DCSP(s) by reducing the amplitude of the associated dynamic current waveform.

Changing DCSP through an Execution of Dummy Processing Events is now described in detail. In the process of the Execution of Dummy Processing Events, the frequency and/or amplitude of the dynamic current waveform for a particular subsystem is changed by executing one or more than one dummy processing event inside a processing window for that subsystem.

Figure 8:
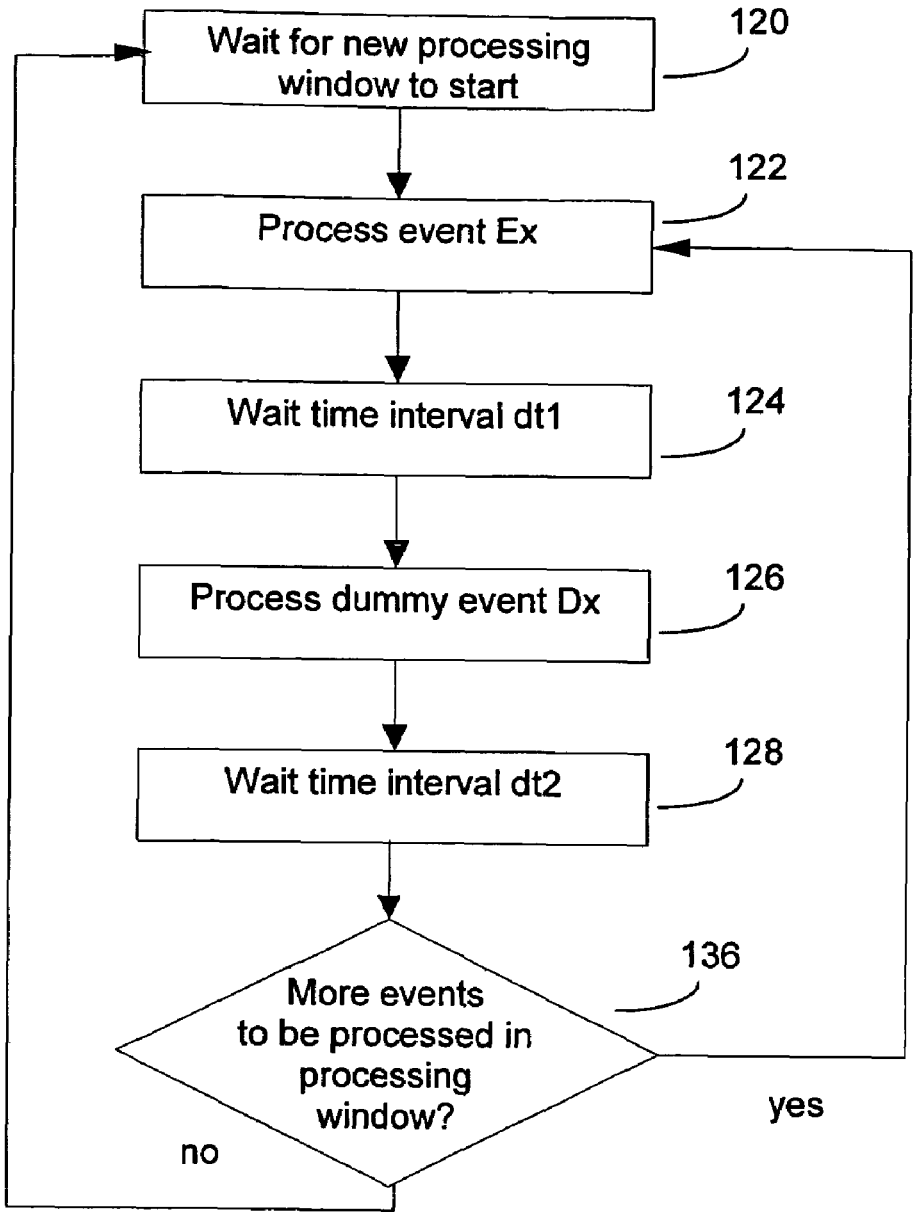
FIG. 8 is a flow chart showing one example of operation for an Execution of Dummy Processing Events.

FIG. 8 is a flow chart showing one example of operation for the Execution of Dummy Processing Events.

The digital subsystem Sx (e.g., S1, S2, or S1 and S2 of FIG. 1) waits for start of a new processing window (step 120). In the new processing window, one or more than one processing event Ex is executed (step 122). The digital subsystem Sx waits a time interval dt1 (step 124). Then, one or more than one dummy event Dx (step 126) is processed in the digital subsystem Sx. The digital subsystem Sx waits a time interval dt2 (step 128). It is determined whether there is any event(s) to be processed in the processing window (step 130). If yes, the digital subsystem Sx retunes to step 122. If no, the digital subsystem Sx returns to step 120.

By inserting one or more dummy events, the frequency of the dynamic current waveform is increased. Depending on the amount of operations that is performed within the dummy processing event, the amplitude of the dynamic current waveform may also be reduced. A dummy processing event is generated by having the subsystem in question execute operations that may not be needed for the application but are only inserted to increase the frequency and/or reduce the amplitude of the dynamic current waveform.

Figure 9:
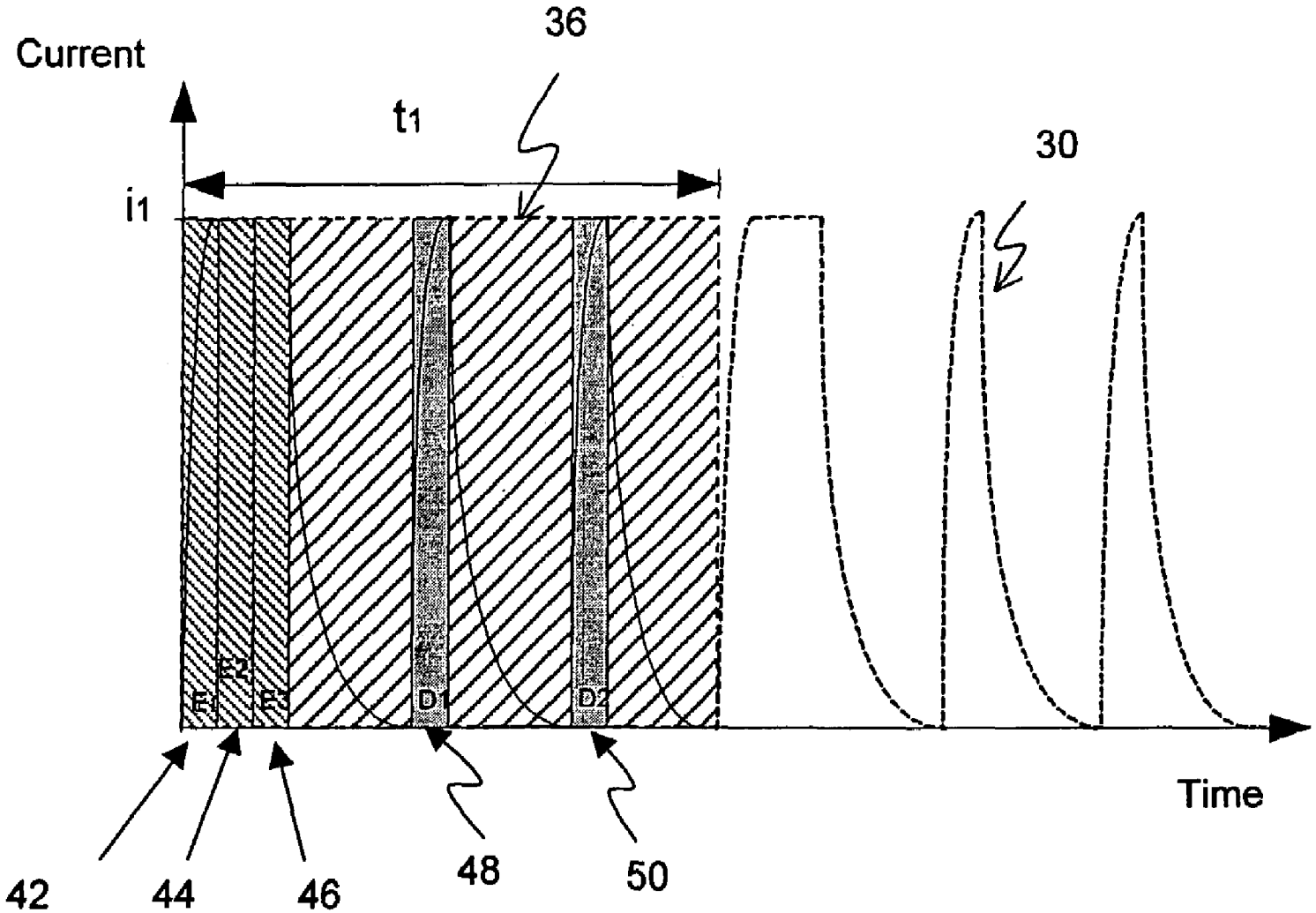
FIG. 9 is a diagram showing one example of the Execution of Dummy Processing Events.

FIG. 9 is a diagram showing one example of the Execution of Dummy Processing Events. In FIG. 9, the processing event 42 is executed during cycles 1-5, the processing event 44 is executed during cycles 6-10, and the processing event 46 is executed during cycles 11-15.

For example, dummy events 48 and 50 are executed within the processing window 36 after the event 46 with a certain interval. As illustrated in FIG. 9, the frequency of the dynamic current waveform 30 for the subsystem S1 is increased by executing the two dummy processing events 48 and 50 in the processing window 36.

The dummy processing event may include a processing event executed by the subsystem S1, which may or may not be related to the other processing events 42, 44, and 46. The number and durations of the dummy events shall be considered as fully configurable (which affects the frequency of the dynamic current waveform).

The load related to each dummy processing event is fully configurable (affects the amplitude of the dynamic current waveform). For example, if the dummy processing event 48 represents a load that contains an amount of operations 01 and the dummy processing event 50 contains an amount of operations O2 and O2>O1 then 50 has a higher load. For example, two multiplications in a subsystem will consume more current than 1 multiplication in that same subsystem.

The dummy processing event may include a processing event executed by the subsystem S2 of FIG. 1, which may or may not be related to the processing events 42, 44 and 46 executed by the subsystem S1 of FIG. 1. The number and durations of the dummy events from other subsystems are fully configurable. Furthermore, the load related to each dummy processing event from other subsystems is fully configurable.

In either of the two cases mentioned above, start timing and stop timing and load of the dummy events are configurable.

The number of cycles between an event and a dummy event can be configured by simply setting the count between the two types of events.

By choosing the appropriate number, the appropriate duration and the appropriate time intervals of the dummy processing events, the IAB dynamic current is transformed into OAB dynamic current. Furthermore, by reducing the load of the dummy event, the amplitude of the dynamic current waveform is reduced.

It is also possible to replace dummy events with processing events that perform a useful function. In this case, the signal processing algorithm is repartitioned so that processing that can be executed on a digital subsystem replaces a dummy event.

Changing DCSP through a Random Delayed Execution of Processing Events is now described in detail. In the process of the Random Delayed Execution of Processing Events, a random or pseudo-random variable delay $d_r(t)$ is inserted before the execution of processing events.

Figure 10:
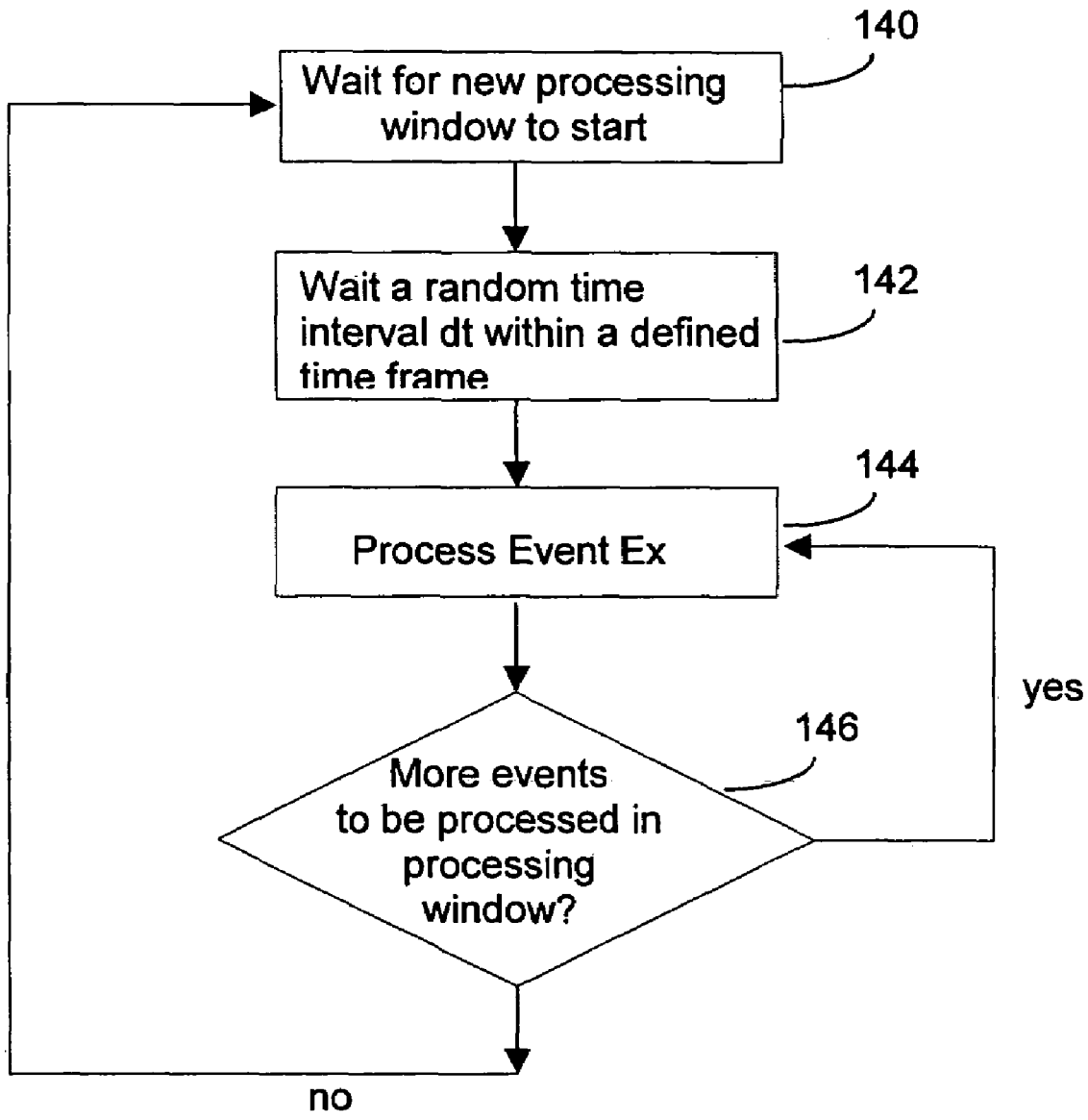
FIG. 10 is a flow chart showing one example of operation for a Random Delayed Execution of Processing Events

FIG. 10 is a flow chart showing one example of operation for the Random Delayed Execution of Processing Events.

The digital subsystem Sx (e.g., S1, S2 or S1 and S2 of FIG. 1) waits for start of a new processing window (step 140). In the new processing window, the digital subsystem Sx waits a random time interval dt within a defined time frame (step 142). A processing event Ex is executed (step 144). It is determined whether there is any event(s) to be processed in the processing window (step 146). If yes, the digital subsystem Sx retunes to step 144. If no, the digital subsystem Sx returns to step 140.

The duration between the events from one processing window to the next varies randomly, i.e. the duration between events in one processing window and the similar events in the following processing window vary across processing windows. The variations in the random delays are provided such that three processing events 42, 44 and 46 are all executed within a given processing window. The delay may be provided by a random generator that counts a random number of cycles (within the specified boundaries) between a processing event in one processing window and the similar processing event in the following window. The delay boundary is determined such that a processing event can always be executed within the desired processing window. If the delay is larger than the boundary, the processing event would not be processed within the desired processing window, but would have to be executed in the following processing window, which would result in erroneous execution of said processing event. The frequency properties of the events are not fixed, i.e., there is no fixed interval between events 42, 44 and 46 from processing window to the events 42, 44 and 46 in the following processing window and thus no periodic behavior that will result in a periodic dynamic current and as such a high-amplitude fundamental frequency that is IAB.

Figure 11:
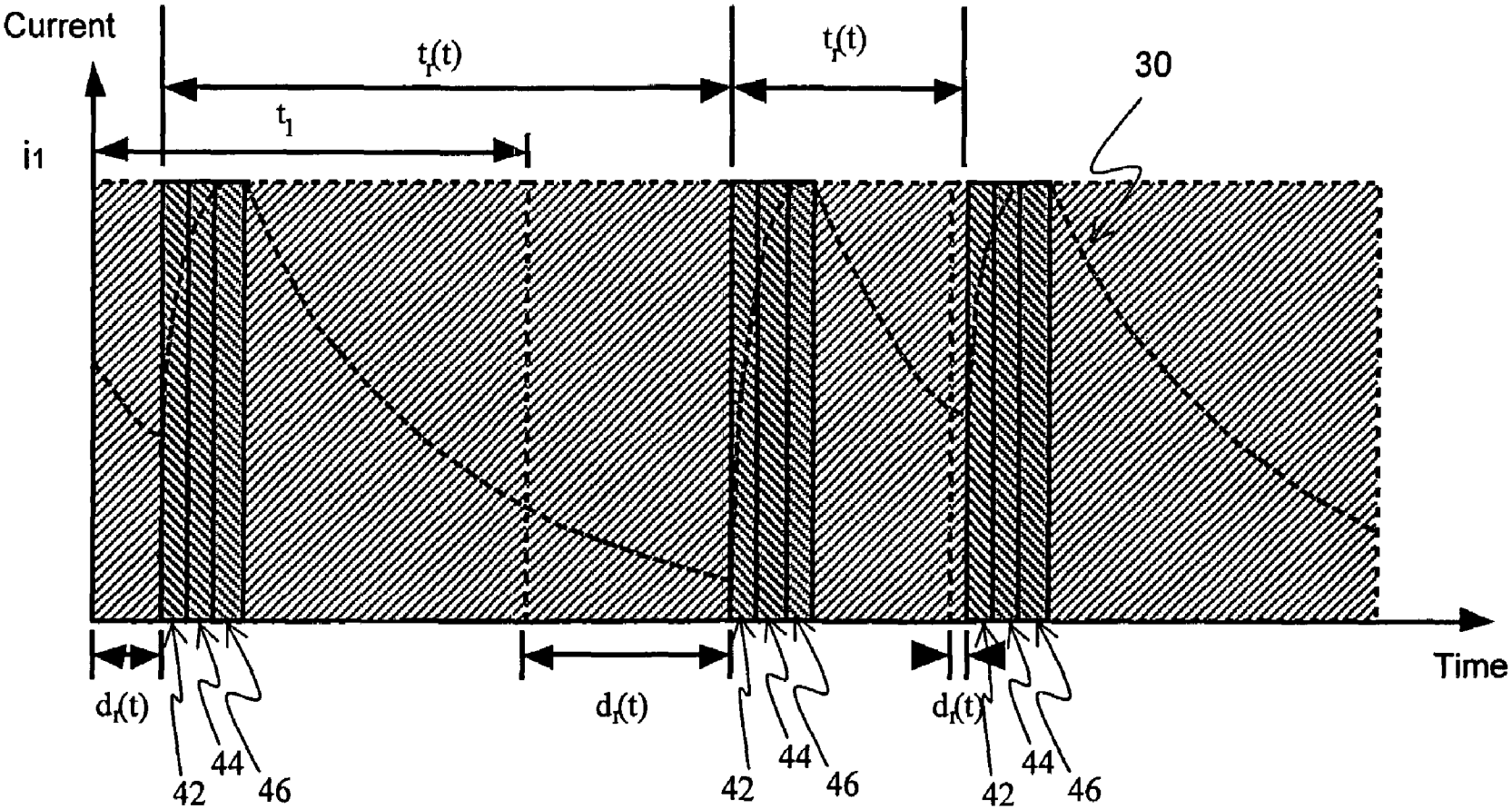
FIG. 11 is a diagram showing one example of the Random Delayed Execution of Processing Events.

FIG. 11 is a diagram showing one example of the Random Delayed Execution of Processing Events.

In FIG. 11, the value of $d_r(t)$ is a random or pseudo-random value between 0 and $t_1$-$t_p$ (the processing period minus the processing time). $t_1$ is also known as the time duration of the processing window. Because the time $t_r(t)$ between the start of two sets of processing events in two subsequent processing windows is not constant, and varies between 0 and $2*t_1-2*t$, the spectrum of the dynamic current waveform is changed. The fundamental frequenc y of the noise is not constant, and is constantly moved between 0 and $1/(2*t_1-2*t_p)$ across processing windows. The overall result of the random delay insertion is a dispersal of the noise energy in several bands of energy. The noise is more a "white" noise. A random delay, may be the result of having a counter that counts a random number of clock cycles (the random number being constrained by a set of boundaries).

Figure 12:
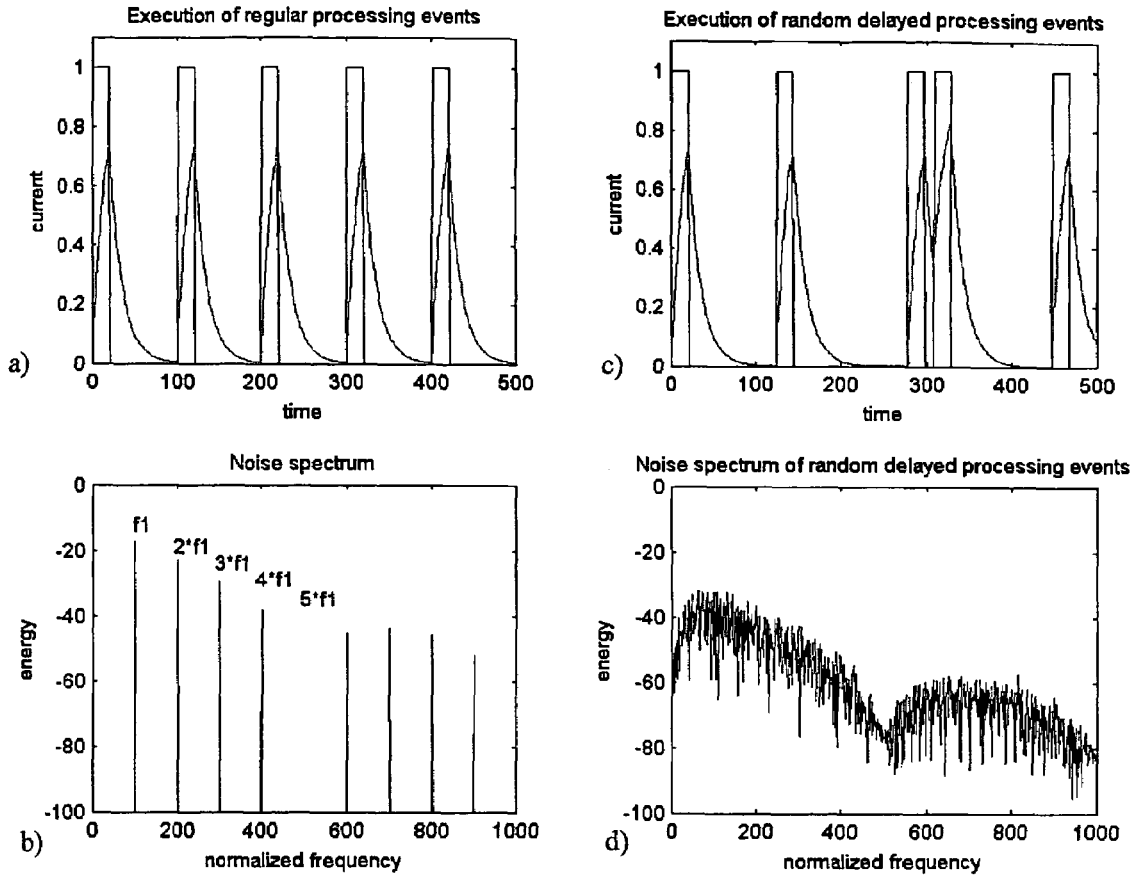
FIGS. 12(*a*)-(*d*) are graphs showing one example of the effect of the Random Delayed Execution of Processing Events.

FIGS. 12(*a*)-(*d*) are graphs showing one example of the effect of the Random Delayed Execution of Processing Events on the hearing aid 1 of FIG. 1. FIGS. 12(*a*) and (*b*) are related, and Figures (c) and (d) are related. FIG. 12(*a*) shows processing events and the associated dynamic current waveforms. FIG. 12(*b*) shows the spectrum (frequency vs. amplitude) of the dynamic current waveform. FIG. 12(*c*) shows the processing events plus dynamic current waveform after the random delayed execution method has been applied. FIG. 12(*d*) shows the spectrum of the dynamic current waveform after the Random Delayed Execution of Processing Events has been applied.

As illustrated in FIGS. 12(*a*)-(*d*), the spectrum after applying this method is more white (and therefore more energy is OAB) compared to the comparative case where the spectrum is highly tonal (with more energy is IAB).

Figure 13:
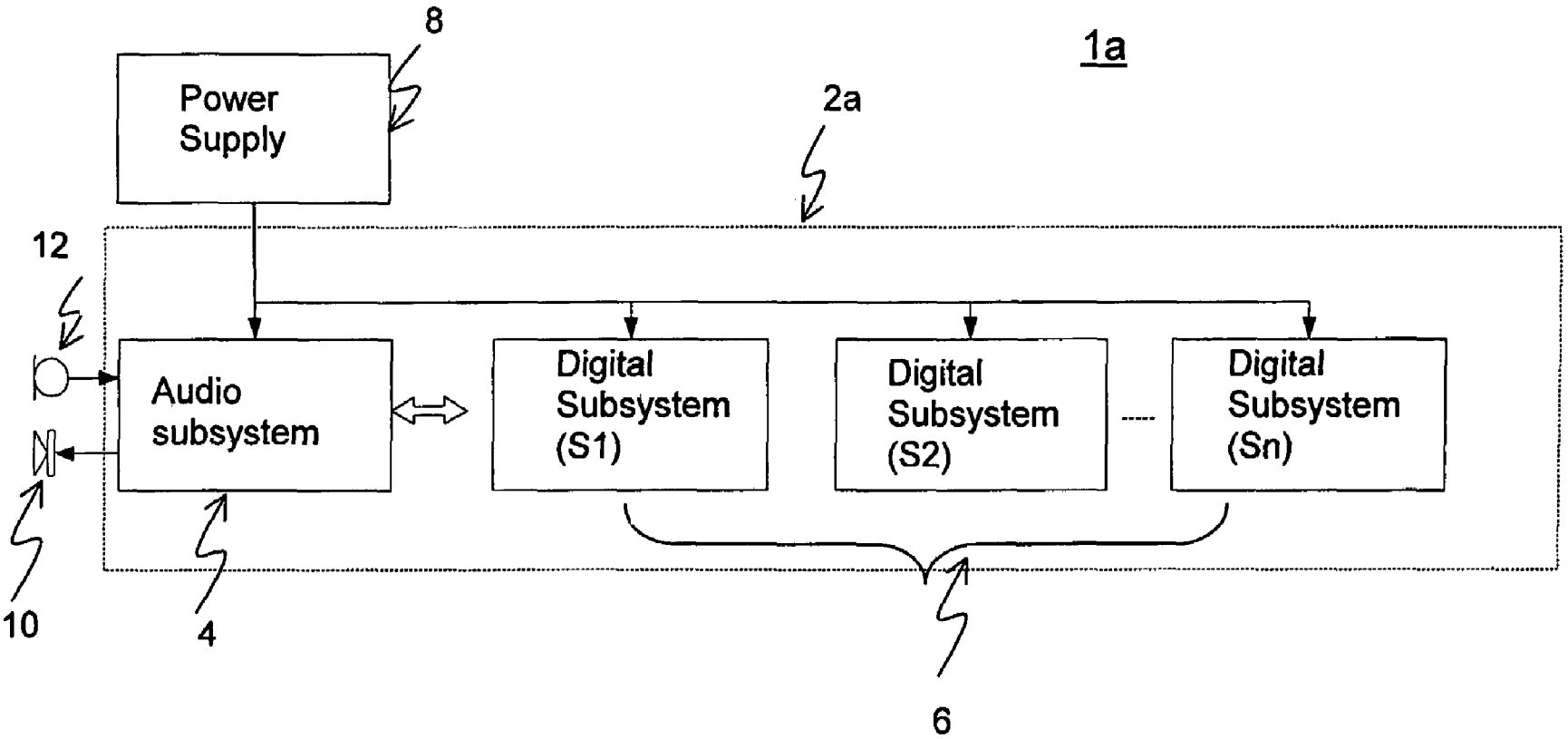
FIG. 13 is a schematic diagram showing a hearing aid including a plurality of digital subsystems to which the side effects reduction in accordance with an embodiment of the present invention is suitably applied.

In FIG. 1, two digital subsystems S1 and S2 are shown. However, the side effects reduction in accordance with the embodiment(s) of the present invention is applicable to a system having any number of subsystems. For example, the audio processing system 2 may include more than two digital subsystems. FIG. 13 shows the hearing aid 1*a* that includes an audio processing system 2*a*. The audio processing system 2*a* includes digital subsystems S1, S2, . . . , Sn, where "n" corresponds to the subsystem number and greater than 2. The digital subsystems S1, S2, . . . , Sn and the audio subsystem 4 share the power supply 8.

Figure 14:
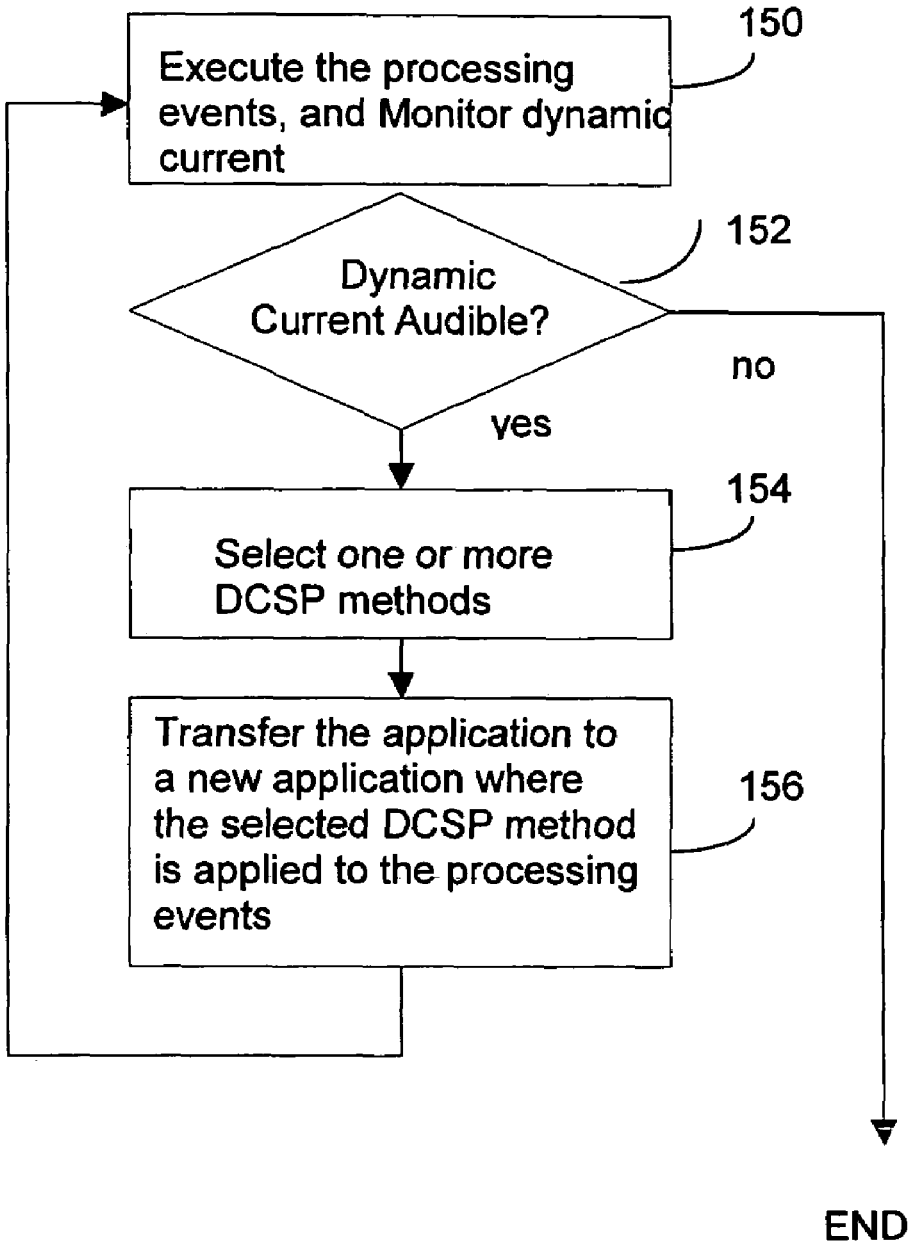
FIG. 14 is a flowchart showing operation for reducing audible side effects in accordance with an embodiment of the present invention.

FIG. 14 shows one example of an operation for reorganizing the processing events of the audio processing system (2 of FIG. 1, 2*a* of FIG. 13). The reorganization process according to FIG. 14 is performed during the development of the audio processing system (2, 2*a*). It is assumed that an application P1 (or program) is in the audio processing system, and a plurality of processing events are defined in the application P1.

The audio processing system executes the processing events as they are implemented. During the execution, an application developer monitors dynamic current consumption in the audio processing system (step 150). Based on the monitoring, the developer determines whether the dynamic current of the audio processing system is audible (step 152). If yes, the developer selects one or more than one DCSP method (step 154), which will apply to the processing events within all of the processing windows. The application P1 is transferred to a new application P2 (step 156), which contains P1 with the selected DCSP method(s). In the new application P2, the processing events are reorganized by the selected DCSP method(s).

The reorganized processing events are executed as they are implemented. The developer monitors dynamic current consumption in the audio processing system (step 150). Based on the monitoring, the developer determines whether the dynamic current of the audio processing system is audible (step 152). If yes, the developer selects one or more than one DCSP method (step 154), which will apply to the processing events within all of the processing windows. The application P2 is transferred to a new application P3 (step 156) where the processing events are reorganized by the newly selected DCSP method(s). The executing/monitoring step, the determining step, the selecting step and the transferring step are repeated until undesired audible artefacts are reduced to a certain level.

In the monitoring step, the developer may listen to audible outputs from the speaker (10 of FIGS. 1 and 13) to find audible artefacts.

Figure 15:
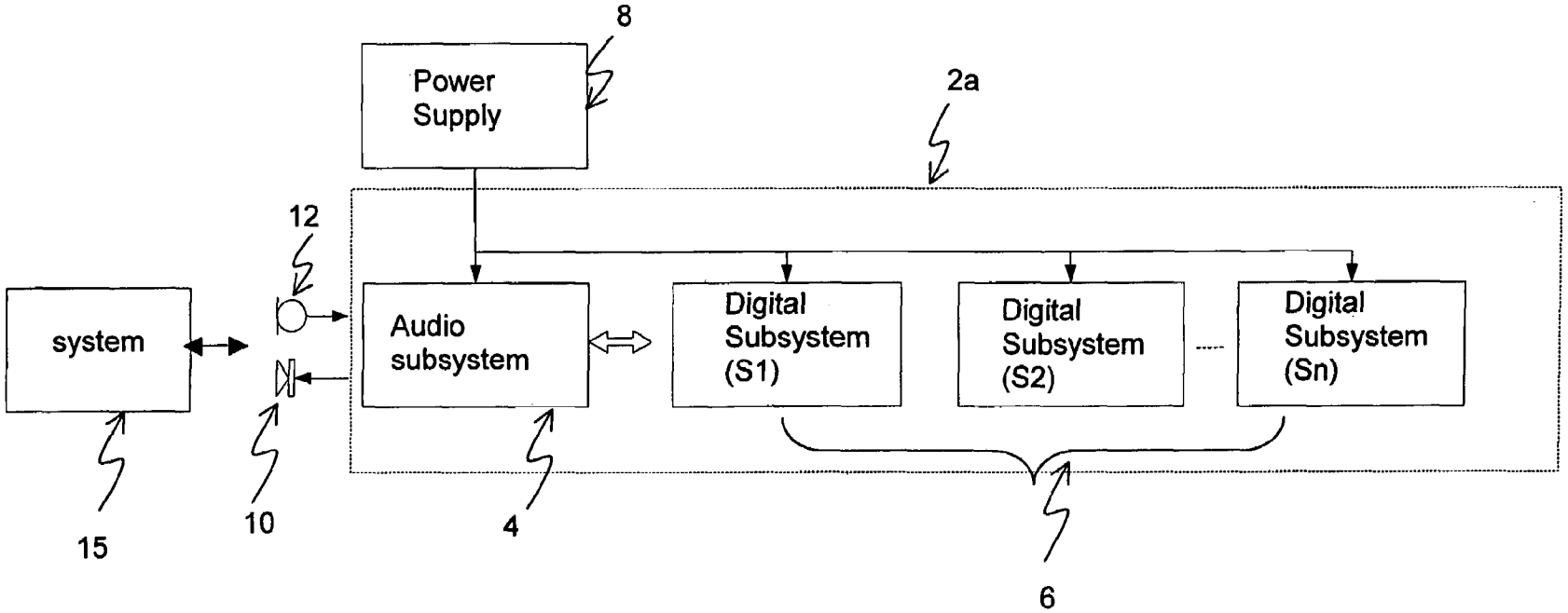
FIG. 15 is a block diagram showing one example of a system for implementing the operation of FIG. 14.

In the above description, the application developer performs the monitoring, determining and selecting steps. However, as shown in FIG. 15, a system 15 may be provided to the hearting aid 1 to calibrate the audio processing system 2*a* (or 2 of FIG. 1). The monitoring and determining steps may be automatically performed by the system 15. The system 15 may adjust the threshold to determine whether there are undesired audible artefacts. The selecting step may be automatically performed by the system 15. The system 15 may adjust the time interval of FIG. 4, the time interval of FIG. 6, the configuration of the dummy events of FIG. 8, the random time interval of FIG. 10 or combinations thereof. The system 15 may have a memory to store the time interval of FIG. 4, the time interval of FIG. 6, the configuration of the dummy events of FIG. 8, the random time interval of FIG. 10, or combinations thereof.

The steps of FIG. 14 may be performed in a listening device (e.g., 2 of FIG. 1, 2*a* of FIG. 13), or in a design environment during the design process.

The side effects reduction of the present invention may be implemented in any of the digital subsystems that take part of the system. Parameters for the DCSP method are configurable and may be downloaded to the system upon initialization. For a hearing aid, these configuration parameters may be stored in a non-volatile memory and downloaded to the configuration portion of a given subsystem upon battery insertion in the device.

The side effects reduction of the present invention may be implemented during the design process of the audio processing systems. Parameters for the DCSP method may be obtained, used, and refined for the design.

The side effects reduction of the present invention may be implemented in the audio processing system in situ. For example, a listening device will be adaptive to the usage and the environment of the device, and implement one, or more than one of the methods described above during the usage.

The side effects reduction of the present invention may be implemented by any hardware, software or a combination of hardware and software having the above described functions. The software code, either in its entirety or a part thereof, may be stored in a computer readable medium. Further, a computer data signal representing the software code which may be embedded in a carrier wave may be transmitted via a communication network. Such a computer readable medium and, a computer data signal and carrier wave are also within the scope of the present invention, as well as the hardware, software and the combination thereof.

The present invention has been described with regard to one or more embodiments. However, it will be apparent to persons skilled in the art that a number of variations and modifications can be made without departing from the scope of the invention as defined in the claims.

What is claimed is:

1. A method of reducing the audible side effects of dynamic current consumption in a listening device having a plurality of subsystems, the method comprising:

in a subsystem, executing at least one processing event within a processing window based on a timing schedule, the processing window being periodic;

monitoring in-audio-band dynamic current caused by the at least one processing event, and transforming the in-audio-band dynamic current to out-of-audio-band dynamic current, including at least one of:

after the execution of one processing event waiting a first time interval different from a second time interval defined by the timing schedule, and after the first time interval executing the other processing event so that the one processing event and the other processing event are spread out within the processing window;

waiting a random delay time from a trigger event, and after the random delay time, executing the processing event based on the timing schedule; and executing a dummy processing event within the processing window.

2. A method as claimed in claim 1, wherein transforming comprises:

lengthening a processing time for the at least one processing event within the processing window.

3. A method as claimed in claim 2, wherein the lengthening comprises:

increasing a duration of the at least one processing event within the processing window.

4. A method as claimed in claim 1, further comprising: configuring number, duration or the number and the duration of the dummy processing event.

5. A method as claimed in claim 1, wherein the dummy processing event is a processing event in any one of the subsystems.

6. A method as claimed in claim 1, wherein the random delay time includes a pseudo-random delay.

7. A method as claimed in claim 1, further comprising the step of:

storing a parameter which is used at the reorganization step.

8. A method as claimed in claim 1, wherein the method is performed in a listening device in situ.

9. A method as claimed in claim 1, wherein the method is performed in a develop process, design process or a combination thereof.

10. A system for reducing the audible side effects of dynamic current consumption in a listening device having a plurality of subsystems, the system comprising:

a module for monitoring in-audio-band dynamic current caused by at least one processing event implemented in a subsystem, the at least one processing event being executed within a processing window based on a timing schedule, the processing window being periodic, and a module for transforming the in-audio-band dynamic current to out-of-audio-band dynamic current, including at least one:

a module for spreading out one processing event and the other processing event within the processing window, including a module for waiting a first time interval for the execution of the other processing event after the execution of the one processing event, the first timing interval being different from a second timing interval defined by the timing schedule;

a module for waiting a random delay time from a trigger event so that the processing event is executed based on the timing schedule after the random delay time; and a module for executing a dummy processing event within the processing window.

11. A system as claimed in claim 10, wherein the monitoring module monitors audio signal output from the listening device.

12. A system as claimed in claim 10, wherein the transforming module comprises:

a module for slowing execution of the at least one processing window within the processing window.

13. A computer program product, comprising:

a memory having computer-readable code embodied therein of reducing the audible side effects of dynamic current consumption in a listening device having a plurality of subsystems, comprising:

code for defining at least one processing event executed in a subsystem so that the at least one processing event is executed within a periodic processing window based on a timing schedule; and code for transforming in-audio-band dynamic current caused by the at least one processing event to out-of-audio-band dynamic current, including at least one of:

code for waiting a first time interval different from a second time interval defined by the timing schedule, after the execution of one processing event, and executing the other processing event after the first time interval so that the one processing event and the other processing event are spread out within the processing window;

code for waiting a random delay time from a trigger event, and executing the processing event based on the timing schedule after the random delay time; and code for executing a dummy processing event within the processing window.

14. A computer program product as claimed in claim 13, wherein the code for transforming comprises:

code for lengthening the duration for the at least one processing event within the processing event.

15. A method as claimed in claim 1, wherein the monitoring step monitors an audio signal output from the listening device.

16. A system as claimed in claim 10, wherein the monitoring module monitors an audio signal output from the listening device.

17. A method as claimed in claim 1, further comprising the step of downloading configuration parameters associated with the reorganization to the listening device upon initialization.

18. A system as claimed in claim 10, wherein the listening device includes a memory for storing configuration parameters associated with the reorganization.

* * * * *